United States Patent [19]

Berquist

[11] 3,964,221

[45] June 22, 1976

[54] PLATFORM SECTIONS

[75] Inventor: DeWayne Donald Berquist, Anoka, Minn.

[73] Assignee: Aggressive Industries Inc., St. Paul, Minn.

[22] Filed: Feb. 18, 1975

[21] Appl. No.: 550,518

Related U.S. Application Data

[63] Continuation-in-part of Ser. No. 391,063, Aug. 24, 1973, abandoned.

[52] U.S. Cl. ..... 52/177; 52/592; 61/48; 114/.5 BD; 404/41

[51] Int. Cl.[2] ..... E04F 11/16; E04C 1/30

[58] Field of Search ..... 114/.5 F, .5 BD, 85; 52/309, 263, 589, 177, 592; 61/48; 264/310; 108/53, 24; 404/2, 34, 35, 41; 14/75, 71 R, 27, 28

[56] References Cited

UNITED STATES PATENTS

| | | | |
|---|---|---|---|
| 511,497 | 12/1893 | Blaine | 404/41 |
| 2,680,698 | 6/1954 | Schnee | 404/41 |
| 2,942,535 | 6/1960 | Spangler | 404/41 |
| 3,157,254 | 11/1964 | Spiselman et al. | 404/41 |
| 3,158,003 | 11/1964 | Dally | 52/309 |
| 3,470,058 | 9/1969 | Heffner | 52/309 |
| 3,555,762 | 1/1971 | Costanzo | 52/177 |
| 3,561,375 | 2/1971 | Hammond | 264/310 UX |
| 3,636,888 | 1/1972 | Anglebeck | 108/53 |
| 3,771,495 | 11/1973 | Stevenson et al. | 52/309 |
| 3,780,686 | 12/1973 | Brill | 114/.5 F |

*Primary Examiner*—Stephen G. Kunin
*Assistant Examiner*—Galen L. Barefoot
*Attorney, Agent, or Firm*—James R. Cwayna

[57] ABSTRACT

A supporting surface provided by utilizing a plurality of individual sections which when joined will provide a planar supporting surface and which sections include formed outer skins having a plurality of supporting post sections formed integrally with the skins and extending from the upper skin surface to the lower skin surface thus providing a void between the skins which may be filled with material to provide additional strengthening for the sections. The formed sections include a stepped interlocking feature for joining the sections and the sections are designed to permit a selection of joining arrangements to provide a supporting surface of various configurations. The surfaces may include non-slip characteristics formed integrally with the sections during the molding process.

4 Claims, 9 Drawing Figures

PLATFORM SECTIONS

This application is a continuation-in-part application of my copending application, Ser. No. 391,063, filed 08/24/73, now abandoned, entitled Platform Section.

FIELD OF THE INVENTION

This invention is directed to supporting surfaces which are comprised of a plurality of individual support sections which sections are interlocked and are of various configurations to permit interlocking to obtain a final surface of a desired configuration.

BACKGROUND AND OBJECTS OF THE INVENTION

In the fabrication of docks, decks and other similar supporting surfaces, the problems of rigidity, exposure to weather, rigid interlocking attachment of individual sections for continuity of surface, esthetic design and the like must be taken into consideration.

Applicant provides herein a plurality of shaped sections which sections have interlocking features on selected portions thereof for the rigid joining of sections into a final desired configuration. The particular design of the sections permits their joinder in various configurations.

With applicant's concept, each of the individual sections is formed through a rotocast process such that a continuous exterior skin is provided which exterior skin integrally includes means for interlocking the sections and which exterior skin arrangement through the spacing therebetween provides a void which may be filled with a strengthening material.

It is therefore an object of applicant's invention to provide a support section having a shape and configuration which will allow joining of these sections to provide a support surface of a desired configuration.

It is a further object of applicant's invention to provide a support section which includes a continuous outer skin of a preformed configuration and having vertically arranged support members extending between the upper and lower skins of the section.

It is a further object of applicant's invention to provide a support section having stepped portions on selected areas thereof which stepped portions permit the joining of such sections to one another to provide a final support surface of a desired configuration.

It is still a further object of applicant's invention to provide a support section defined by an exterior skin which skin provides a void which may be filled with a material to increase the strength and rigidity of the section.

It is still a further object of applicant's invention to provide a support section of molded plastic material which incorporates a non-skid design directly molded into selected surfaces thereof.

These and other and objects and advantages of applicant's invention will more fully appear from the accompanying description made in connection with the accompanying drawings in which the same numeral is used to designate the same or similar parts throughout the several views, and in which.

Figure 1:
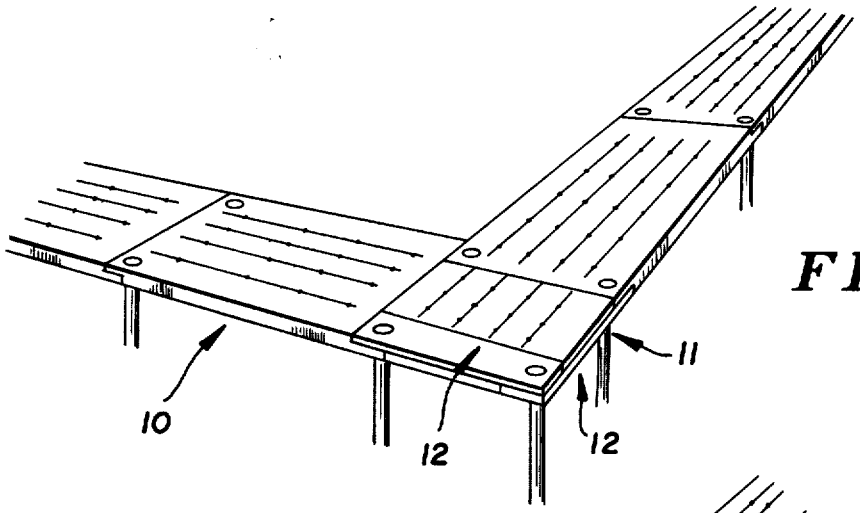
FIG. 1 is a perspective view of a support surface embodying the concepts of applicant's individual support sections to provide a surface of a possible configuration.
Figure 2:
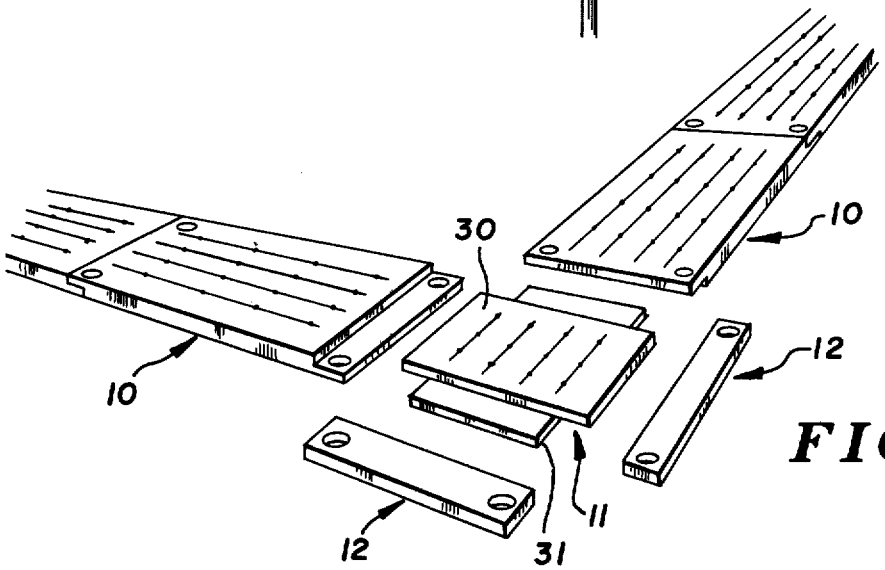
FIG. 2 is a view similar to FIG. 1 illustrating the individual support sections provided by applicant to provide the support surface as shown in FIG. 1.

In accordance with the accompanying drawings, applicant has found that in order to provide a generally planar support surface having a desired number of ultimate configurations, it is necessary to provide three distinct support sections. A first longitudinally extending support section is designated 10, a second supporting Tee section is designated 11 and a third end section is designated 12.

The joinder of these individual support sections and the various ultimate configurations that are available through their joinder will become obvious as this description continues but the manufacturing techniques to provide any or all of these support sections is disclosed herein as related to the longitudinally extending first section 10 which is illustrated in FIGS. 4 through 9. The various construction aspects with relation to this first support section 10 are applicable to either the second Tee section 11 or the third end section 12.

Figure 4:
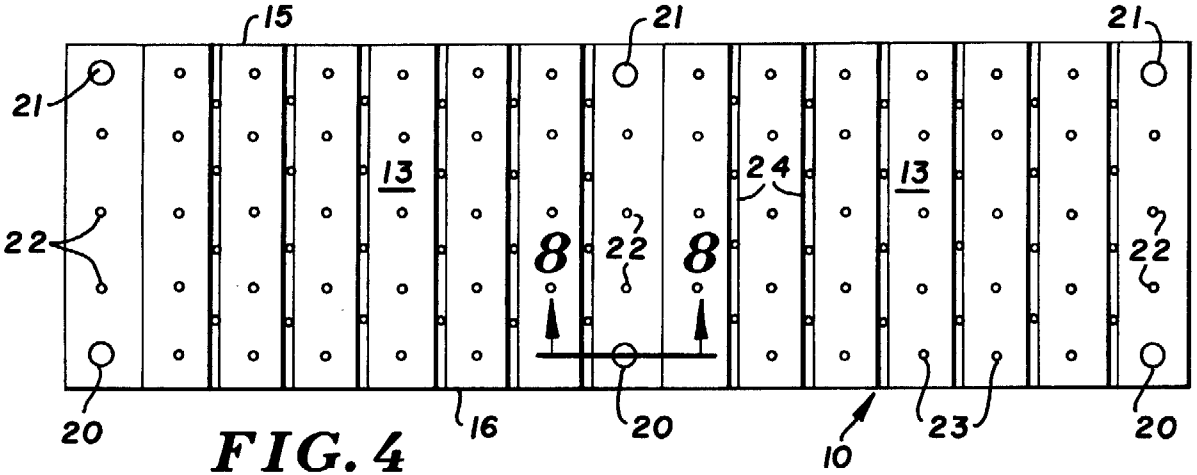
FIG. 4 is a top plan view of a pair of support sections being joined end to end.
Figure 5:
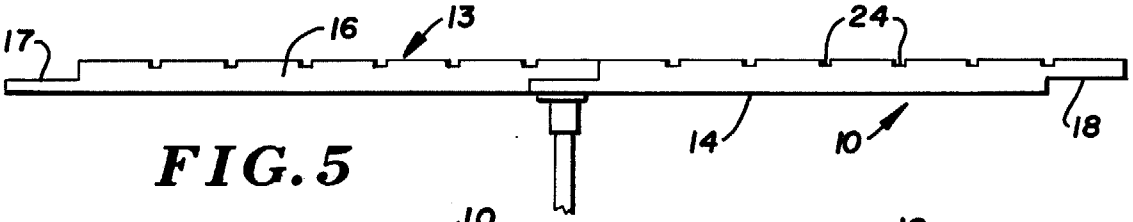
FIG. 5 is a side view taken from FIG. 4.
Figure 6:
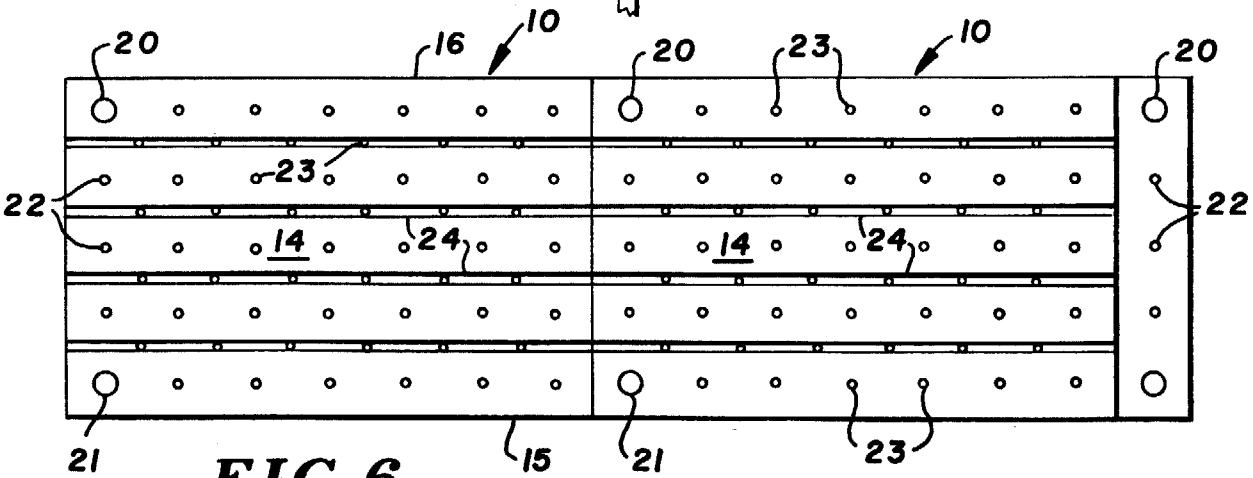
FIG. 6 is a bottom plan view taken from FIG. 5.

As illustrated in FIGS. 4 through 9, and basically FIGS. 4, 5 and 6, each first longitudinally extending section 10 includes an upper surface 13, a lower surface 14 spaced from the upper surface 13, side walls 15 and 16 extending along the longitudinal dimension of this section 10 and formed, stepped end portions such that the longitudinally directed ends of each section 10 are provided with a stepped configuration. This stepped configuration is approximately intermediate the upper 13 and lower 14 surfaces of the section, with the upper surface of the step being designated 17, with the lower surface of the step being designated 18, such that these two stepped surfaces will, when arranged in proper lapped relation, provide that the upper surfaces 13 of adjacent sections 10 are in planar relationship.

A pair of post receiving passages designated 20, 21 are arranged to extend through each of these stepped areas adjacent the side walls 15, 16. These passages 20, 21 of adjacent sections 10 will be in vertical alignment when the stepped areas 17, 18 are properly positioned. This alignment will permit a plurality of support posts such as those illustrated in FIG. 1 to pass through adjacent sections 10 and provide an interlock therebetween.

A second plurality of transversely spaced passages 22 are also formed through these stepped areas and these passages 22 may be utilized as additional connective passages to receive fasteners to more positively join these sections 10 to one another.

With this particular construction of passages through the stepped areas, it should be obvious that the support receiving passages 21, 21 may be utilized as the primary section connector or the attachment apertures 22 could be utilized either in addition thereto or singularly thereof.

Additional passages 23 are arranged to extend vertically between the upper 13 and the lower 14 surfaces of the sections 10.

Figure 9:
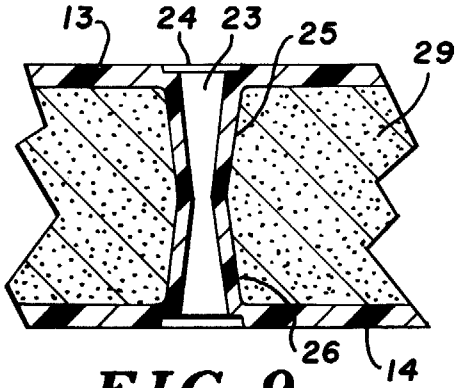
FIG. 9 is a vertical section taken substantially along Line 9—9 of FIG. 8.

The particular cross section of passages 23 is best illustrated in FIG. 9. These passages 23 are formed by providing abutting cone-shaped inserts in the mold such that during the molding process the plastic material will heat around and form around these inserts to form inwardly directed abutting cone-shaped configurations 25, 26. The cone shape is necessary for mold separation. The formed plastic cones 25, 26 form a supporting post and provide the passage 23 which may serve as a drain passage through the sections 10.

In FIGS. 4 and 6 transversely and longitudinally extending grooves are illustrated. These grooves 24 are arranged to intersect with the aforementioned passages 23. Applicant has illustrated the grooves 24 as extending in both directions so as not to limit his design.

As illustrated in FIG. 9, grooves 24 will intersect with the end of selected passages 23 and will provide a graining effect for the upper surface 13 of the section 10 and will further provide an upraised surface effect.

Figure 3:
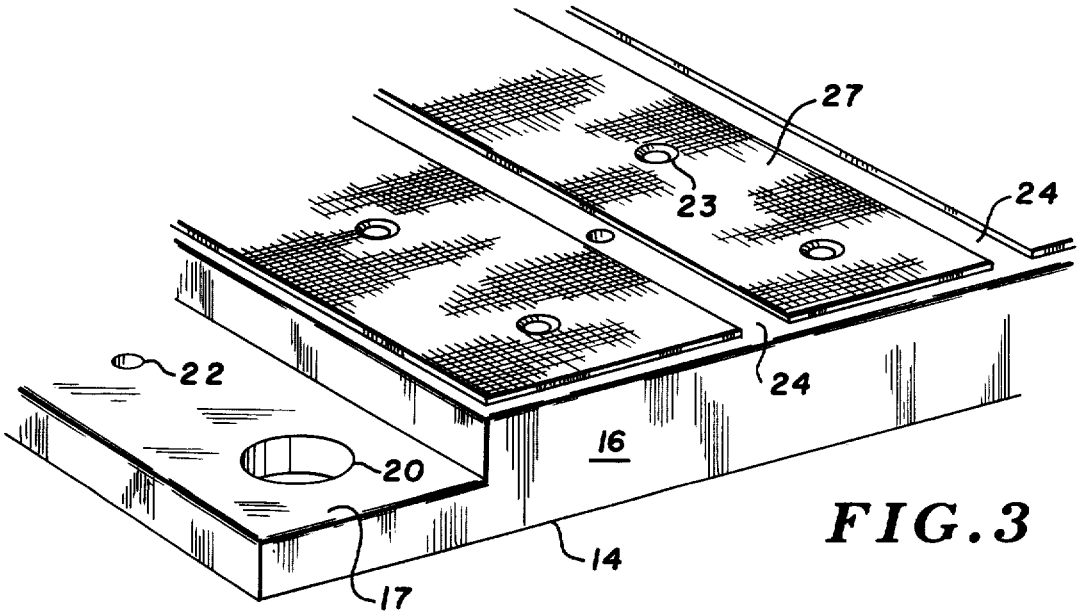
FIG. 3 is a perspective view of a portion of a support section particularly illustrating one surface configuration.
Figure 8:
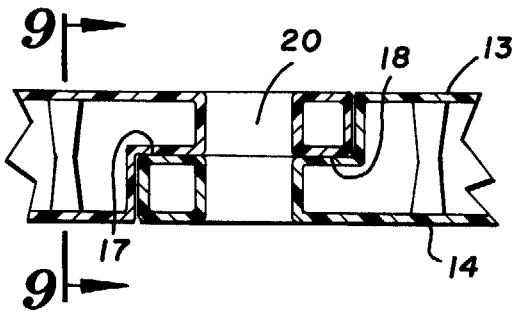
FIG. 8 is a vertical section taken substantially along Line 8—8 of FIG. 4.
Figure 7:
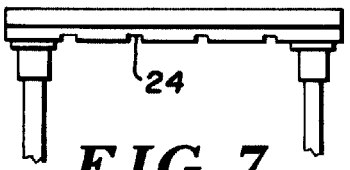
FIG. 7 is an end view taken from FIG. 5.

When considering FIGS. 4 and 6, these upraised areas may represent, particularly when the unit is properly colored, a plurality of deck boards extending transversely across or longitudinally with the section. As illustrated in FIG. 3, a non-skid surface designated 27 may be provided on these raised areas by cross hatching or otherwise abrading the mold surface.

A further constructional situation is included in FIG. 9. As the molded unit provides an interior void having only the support members 25, 26 between the upper 13 and lower 14 surfaces, it is possible to fill this void with an expanding foam material which could greatly increase the strength and rigidity of the unit.

The aforementioned second Tee or cross section 11 includes an upper surface 30 and a lower surface 31 offset at right angles to each other. The widths of these surfaces are identical and the lengths thereof are identical to the width of a first section 10. With proper side and end walls, stepped surfaces are provided on all sides thereof to permit stepped or overlapped connection to the longitudinal section 10. The widths of the upper 30 and lower 31 surfaces of this section 11 are less than the width of the first section 10 and will normally be less than the dimension between the post receiving apertures 20, 21 of the first section 10.

In order to close off and provide a totally planar surface, the third, end or closure section, 12 is provided. These sections 12 are equal in length to the width of the first longitudinal section 10 and agree in width with the size of a step of the first 10 or second 11 sections.

It should be noted that the configuration of the three units as illustrated in FIG. 1 includes first sections 10, one second section 11 and a pair of third sections 12 which will, when joined as illustrated, provide a completely planar support area.

From a further consideration of FIG. 1, it should be obvious that the second, Tee or cross section, 12 will permit longitudinal first sections 10 to extend in all directions normally therefrom.

With the system as illustrated herein, it should be obvious that the same constructional considerations as thoroughly discussed for the first, longitudinal section 10, are applicable to the other sections disclosed herein and this includes the support post receiving passages and the surface supporting posts between the upper and lower surfaces of the other sections without departing from the scope of the invention.

Although applicant's individual sections by themselves provide certain features which are considered to be new to the art, the concept of providing a minimal number of particular shaped sections in order to provide complete latitude in developing a supporting section is thought to be unique in its individual consideration.

Applicant has provided a unit which provides for alternative means of attachment of sections to one another and wherein the minimal number of alternate forms of sections will reduce manufacturing and inventory situations while providing an ultimate unit which is capable of providing support sections usable under various conditions.

What I claim is:

1. A support structure including a plurality of individual first support sections, each such first section including:

a. an upper generally planar surface;

b. a lower surface spaced from said upper surface;

c. side walls extending between said upper and lower surfaces;

d. end walls extending between said upper and lower surfaces, said end walls, side walls, upper and lower surfaces defining a stepped portion extending entirely transversely across said section; and, e. said stepped portion of each of said end walls being respectively oppositely directed whereby next adjacent first sections may overlap upon the stepped portion;

f. each of said support sections being provided with a plurality of longitudinally and transversely aligned axial columns formed between said upper and lower surfaces connecting the same and defining an axial passage therethrough;

g. longitudinally extending grooves being formed in one of said surfaces and connecting the aligned axial passages on said surface; and, h. transversely extending grooves being formed in the other of said surfaces and connecting the aligned passages on said surface.

2. The structure as set forth in claim 1 and a non-skid surface being formed on each of said surfaces between the grooves provided thereon, said non-skid surface being provided by at least longitudinally and transversely arranged abraded areas to form a pattern on said surfaces between said grooves.

3. A support structure including at least a first second and end support sections:

a. said first sections including;

1. an upper generally planar surface;

2. a lower surface spaced from said upper surface;

3. side walls extending between said upper and lower surfaces;

4. end walls extending between said upper and lower surfaces, said end walls, side walls, upper and lower surfaces defining a stepped portion extending entirely transversely across said section; and, 5. said stepped portion of each of said end walls being respectively oppositely directed whereby next adjacent first sections may overlap upon the stepped portion;

b. said second support sections including;

1. an upper generally planar surface;

2. a lower surface spaced from and rotated with respect to said upper surface;
3. end walls and side walls extending between said upper and lower surfaces;
4. said upper and lower surfaces defining pairs of stepped portions at the ends of said upper surface and lower surface, each pair being oppositely directed whereby adjacent first sections may overlap therewith;

c. said first sections being of a predetermined width and length;

d. said upper and lower surfaces of said second sections having lengths equal to the width of said first section, and having widths less than the width of said first section; and, e. said end sections having a length equal to the width of said first sections and having a width equal to one-half the difference between the widths of said first and second sections.

4. The structure set forth in claim 3 and each of said first, second and end sections including:

a. a plurality of longitudinally extending grooves on one side thereof;

b. a plurality of transversely extending grooves on the other side thereof;

c. and a non-skid surface formed on each of said surfaces between the grooves provided thereon, said non-skid surface being formed by providing at least longitudinally and transversely arranged abraded areas to form a pattern on said surface between said grooves.

* * * * *